US010555867B2

(12) United States Patent
Lin et al.

(10) Patent No.: US 10,555,867 B2
(45) Date of Patent: Feb. 11, 2020

(54) MASSAGE MECHANISM

(71) Applicant: Xiamen Mas-Agee Electronic Technology Co., Ltd., Xiamen, Fujian (CN)

(72) Inventors: Xinqiang Lin, Fujian (CN); Junjie Wu, Fujian (CN)

(73) Assignee: Xiamen Mas-Agee Electronic Technology Co., Ltd. (CN)

( * ) Notice: Subject to any disclaimer, the term of this patent is extended or adjusted under 35 U.S.C. 154(b) by 371 days.

(21) Appl. No.: 15/481,498

(22) Filed: Apr. 7, 2017

(65) Prior Publication Data

US 2018/0125741 A1 May 10, 2018

(30) Foreign Application Priority Data

Nov. 8, 2016 (CN) ..... 2016 2 1203000 U

(51) Int. Cl.
*A61H 7/00* (2006.01)

(52) U.S. Cl.
CPC ..... *A61H 7/002* (2013.01); *A61H 7/004* (2013.01); *A61H 7/007* (2013.01); *A61H 2201/0138* (2013.01); *A61H 2201/0149* (2013.01); *A61H 2201/1207* (2013.01); *A61H 2201/1215* (2013.01); *A61H 2201/1463* (2013.01); *A61H 2201/1481* (2013.01)

(58) Field of Classification Search
CPC ..... A61H 7/002; A61H 7/004; A61H 7/007; A61H 2201/1481; A61H 2201/1463; A61H 2201/1215; A61H 2201/0138; A61H 2201/0149; A61H 2201/1207
USPC ..... 601/115
See application file for complete search history.

(56) References Cited

U.S. PATENT DOCUMENTS 1,577,751 A * 3/1926 Paschall ..... A61H 7/004 15/22.1
2,246,689 A * 6/1941 Kost ..... A61H 1/0266 474/26
4,718,408 A * 1/1988 Barreiro ..... A61H 1/00 601/102

(Continued)

FOREIGN PATENT DOCUMENTS

EP 1400230 A1 * 3/2004 ..... A61H 15/0078
WO WO-2015129066 A1 * 9/2015 ..... A61H 7/007

*Primary Examiner* — Timothy A Stanis
*Assistant Examiner* — Nicholas P Dacosta
(74) *Attorney, Agent, or Firm* — PROI Intellectual Property US

(57) ABSTRACT

A massage mechanism includes a housing, a massage rock arm group, massage heads, and a drive apparatus. The massage rock arm group includes a left rock arm group and a right rock arm group. Each rock arm group may rock under limitation of spacing grooves and spacing shafts when driven by the drive apparatus. The drive apparatus implements asynchronous actions of the left rock arm group and the right rock arm group. A swing arm connected in a seesaw manner is disposed on each rock arm, so that the massage heads can automatically fit an S curve of a back of a human body, and can be automatically attached to the human body. The present application implements a synchronous kneading function, an asynchronous rubbing function, and a function of performing massage by massage heads that can be automatically attached to a human body, thereby improving user experience.

3 Claims, 3 Drawing Sheets

(56) References Cited

U.S. PATENT DOCUMENTS 5,630,790 A * 5/1997 Ito ..... A61H 1/00 601/102
5,792,080 A * 8/1998 Ookawa ..... A61H 1/00 601/102
5,797,859 A * 8/1998 Prehodka ..... A61H 7/004 601/113
5,877,570 A * 3/1999 Chen ..... F16H 37/065 310/75 R
6,099,487 A * 8/2000 Chen ..... A61H 1/00 310/75 R
6,213,962 B1 * 4/2001 Shimizu ..... A61H 15/0078 601/90
6,623,438 B1 * 9/2003 Wu ..... A61H 15/0078 601/100
6,808,500 B1 * 10/2004 Cheng-Yi ..... A61H 15/0078 601/102
6,814,710 B1 * 11/2004 Dehli ..... A61H 15/0078 601/100
6,832,991 B1 * 12/2004 Inada ..... A61H 39/04 601/100
7,131,954 B2 * 11/2006 Liao ..... A61H 15/00 601/99
8,066,652 B2 * 11/2011 Wu ..... A61H 7/007 601/84
8,105,253 B2 * 1/2012 Chen ..... A61H 7/004 601/112
8,182,436 B2 * 5/2012 Zhong ..... A61H 7/004 601/115
8,202,235 B2 * 6/2012 Huang ..... A61H 7/004 601/101
2004/0171972 A1 * 9/2004 Shimizu ..... A61H 15/00 601/99
2004/0249321 A1 * 12/2004 Grueger ..... B60N 2/976 601/99
2006/0142676 A1 * 6/2006 Fujii ..... A61H 9/0078 601/98
2007/0021695 A1 * 1/2007 Wu ..... A61H 7/004 601/99
2007/0060851 A1 * 3/2007 Ferber ..... A61H 7/004 601/99
2009/0124940 A1 * 5/2009 Nishio ..... A61H 15/0078 601/49
2009/0227915 A1 * 9/2009 Chiang ..... A61H 1/00 601/115
2009/0270780 A1 * 10/2009 Wu ..... A61H 7/007 601/134
2010/0268132 A1 * 10/2010 Wu ..... A61H 7/007 601/98
2010/0318008 A1 * 12/2010 Wu ..... A61H 7/007 601/134
2011/0160627 A1 * 6/2011 Huang ..... A61H 7/004 601/46
2011/0196274 A1 * 8/2011 Ding ..... A61H 7/007 601/136
2012/0265112 A1 * 10/2012 Chen ..... A61H 15/0078 601/115
2013/0245515 A1 * 9/2013 Chen ..... A61H 7/007 601/101
2014/0276277 A1 * 9/2014 Chen ..... A61H 7/004 601/112
2015/0133834 A1 * 5/2015 Ran ..... A61H 7/007 601/112
2016/0374885 A1 * 12/2016 Tan ..... A61H 1/008 601/134
2017/0156975 A1 * 6/2017 Mills ..... A61H 23/0254
2017/0258669 A1 * 9/2017 Ishikawa ..... A61H 7/007
2018/0125741 A1 * 5/2018 Lin ..... A61H 7/002
2019/0053971 A1 * 2/2019 Pan ..... A61H 99/00
2019/0151187 A1 * 5/2019 Nagamitsu ..... A61H 7/007

* cited by examiner

MASSAGE MECHANISM

CROSS REFERENCE TO RELATED APPLICATIONS

The present application claims the benefit of Chinese Patent Application No. 201621203000.2 filed on Nov. 8, 2016. All the above are hereby incorporated by reference.

BACKGROUND

Technical Field

The present application relates to the field of massage chairs, and in particular, to a massage mechanism.

Related Art

Existing massage chairs have a single function. Mechanisms of the massage chairs can generally implement left-right side synchronous kneading motion only, but cannot implement left-right side asynchronous rubbing motion, resulting in poor user experience.

SUMMARY

An objective of the present application is to provide a feasible massage mechanism, so as to overcome the foregoing disadvantages in the prior art.

To achieve the foregoing objective, the present application uses the following technical solutions.

A massage mechanism, including: a housing, a massage rock arm group, massage heads, and a drive apparatus, where the massage rock arm group includes a left rock arm group and a right rock arm group, the left rock arm group and the right rock arm group are respectively mounted on a left side and a right side of the housing in a symmetric manner, and the left rock arm group and the right rock arm group both consist of an upper rock arm and a lower rock arm that are hingedly connected to one other; the massage heads are disposed on the rock arms; the drive apparatus is mounted in the housing; an upper spacing groove is disposed on each upper rock arm and a lower spacing groove is disposed on each lower rock arm; spacing shafts corresponding to the spacing grooves are disposed on the housing; and hinged joints, each between an upper rock arm and a lower rock arm and driven by the drive apparatus, drive the left rock arm group and the right rock arm group to perform spacing rocking according to the spacing grooves, where the drive apparatus includes a motor, a left worm wheel, a right worm wheel, a small left gear, a small right gear, a large left gear, a large right gear, a left handle, a right handle, a left connecting shaft, a right connecting shaft, and a pin rotating shaft, where an output shaft of the motor forms a worm, and the worm is simultaneously engaged with the left worm wheel and the right worm wheel; the small left gear and the small right gear are respectively mounted on a mounting shaft of the left worm wheel and a mounting shaft of the right worm wheel, and the small left gear and the small right gear are respectively engaged with the large left gear and the large right gear; a left drive shaft extends from a center of the large left gear, the left drive shaft is connected to one end of the left handle, and the left connecting shaft connects the other end of the left handle to the hinged joint of the left rock arm group; a step shaft, half of whose end portion is shaved off, extends from a center of the large right gear; a shaft hole is processed and formed at a center of the step shaft; the pin rotating shaft is connected to the shaft hole in a sleeving manner with a clearance fit; a pin perpendicular to an exterior cylindrical surface of the pin rotating shaft is disposed at a place, of an extension portion of the pin rotating shaft, that corresponds to a step position of the step shaft; the extension portion of the pin rotating shaft is connected to one end of the right handle, and the right connecting shaft connects the other end of the right handle to the hinged joint of the right rock arm group.

Preferably, the drive apparatus further includes a gear cover on which a shaft hole is formed; a step cover, half of whose end portion is shaved off, extends from an upper surface of the gear cover; several stiffeners extend from an upper surface of the large right gear; slots engaged with the stiffeners are processed and provided on a lower portion of the gear cover, and when the gear cover is connected to the large right gear in a sleeving manner, the step cover is aligned with the step shaft on the large right gear.

Preferably, the upper spacing grooves are arc-shaped, and circular centers of the upper spacing grooves are toward the housing; the lower spacing grooves are arc-shaped, and circular centers of the lower spacing grooves are away from the housing.

Preferably, the massage mechanism further includes swing arms that are respectively disposed on the left lower rock arm and the right lower rock arm; multiple massage heads are mounted on an upper portion of each swing arm; a hingedly-connected bracket extends from a lower portion of each swing arm; a bracket with a U-shaped opening extends from an upper surface of each lower rock arm, and the hingedly-connected brackets are inserted into and hingedly connected to the bracket with a U-shaped opening, so that the swing arms are connected to the lower rock arms in a seesaw manner.

After using the foregoing technical solutions, compared with the techniques in the background, the present application has the following advantages:

1. By simply transforming a left-side drive apparatus, a left rock arm group and a right rock arm group may move synchronously, or a left rock arm group may lag behind a right rock arm group by half a period, thereby a synchronous kneading function and an asynchronous rubbing function can be respectively implemented.

2. By disposing a swing arm that is connected to a lower rock arm in a seesaw manner, massage heads can automatically fit an S curve of a back of a human body and can be automatically attached to the human body, thereby improving user experience.

DETAILED DESCRIPTION

To make the objectives, technical solutions, and advantages of the present application clearer, the following further describes, in detail, the present application with reference to the accompanying drawings and embodiments. It should be understood that the specific embodiments described herein are merely for explaining the present application, and are not intended to limit the present application.

Embodiment

A left direction, a right direction, an upper direction and a lower direction described in the present application are limited according to usage statuses of the present application. A left direction and a right direction of a back of a user are defined as the left direction and the right direction described in the present application, and a direction corresponding to a shoulder and a direction corresponding to a waist are respectively the upper direction and the lower direction.

Figure 1:
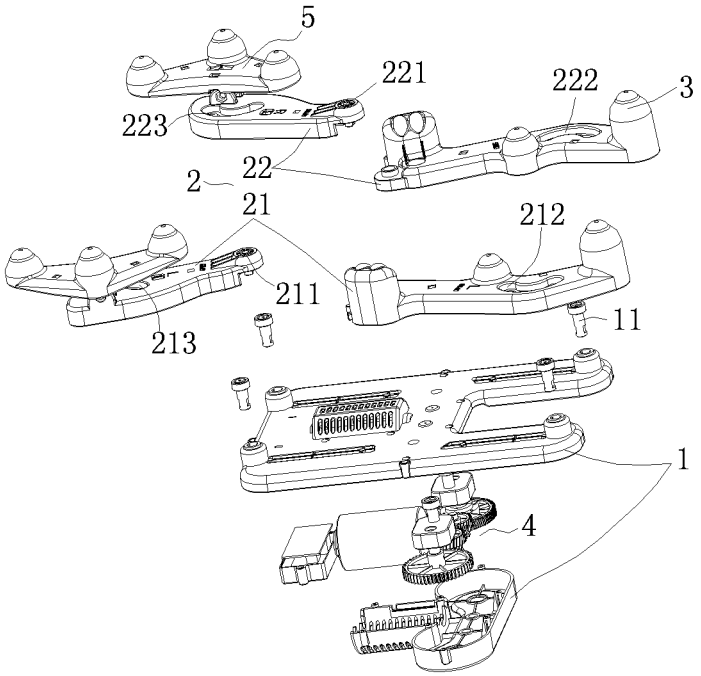
FIG. 1 is a structural exploded view of the present application.
Figure 2:
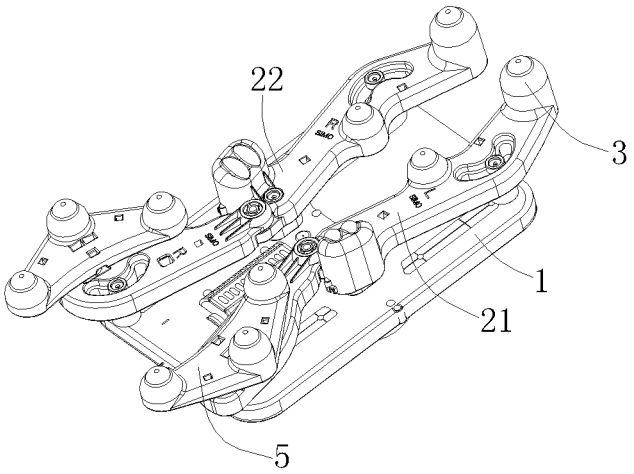
FIG. 2 is a general view of an assembly according to the present application.
Figure 3:
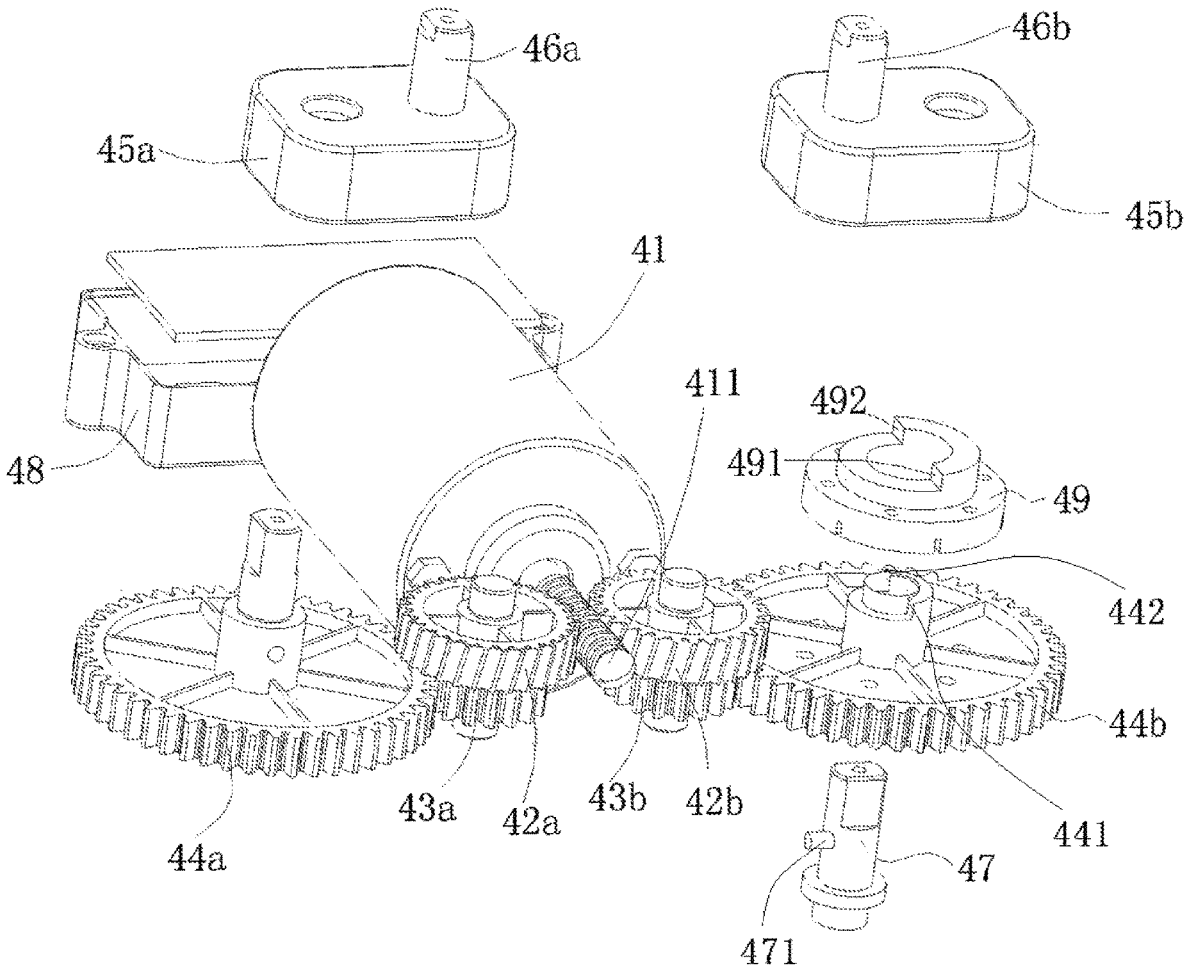
FIG. 3 is a schematic diagram of a drive apparatus according to the present application.

As shown in FIG. 1 and FIG. 2, a massage mechanism includes a housing 1, a massage rock arm group 2, massage heads 3, and a drive apparatus 4. The massage rock arm group 2 includes a left rock arm group 21 and a right rock arm group 22. The left rock arm group 21 and the right rock arm group 22 are respectively mounted on a left side and a right side of the housing 1 in a symmetric manner. The left rock arm group 21 and the right rock arm group 22 both consist of an upper rock arm and a lower rock arm that are hingedly connected to one other. Multiple massage heads 3 are respectively disposed at corresponding positions on the rock arms according to parts to be massaged. The drive apparatus 4 is mounted in the housing 1. A hinged joint 211 and a hinged joint 221, each between an upper rock arm and a lower rock arm and driven by the drive apparatus 4, respectively drive the left rock arm group 21 and the right rock arm group 22 to move. As shown in FIG. 3, the drive apparatus 4 includes a motor 41, a left worm wheel 42*a*, a right worm wheel 42*b*, a small left gear 43*a*, a small right gear 43*b*, a large left gear 44*a*, a large right gear 44*b*, a left handle 45*a*, a right handle 45*b*, a left connecting shaft 46*a*, a right connecting shaft 46*b*, a pin rotating shaft 47, and an electrical box 48. An output shaft of the motor 41 forms a worm 411. The worm 411 is simultaneously engaged with the left worm wheel 42*a* and the right worm wheel 42*b*. The small left gear 43*a* and the small right gear 43*b* are respectively mounted on a mounting shaft of the left worm wheel 42*a* and a mounting shaft of the right worm wheel 42*b*. The small left gear 43*a* and the small right gear 43*b* are respectively engaged with the large left gear 44*a* and the large right gear 44*b*. A left drive shaft extends from a center of an upper surface of the large left gear 44*a*. The left drive shaft is connected to one end of the left handle 45*a*. The left connecting shaft 46*a* connects the other end of the left handle 45*a* to the hinged joint 211 of the left rock arm group 21. A step shaft, half of whose end portion is shaved off, extends from a center of the large right gear 44*b*. A shaft hole is processed and formed at a center of the step shaft. The pin rotating shaft 47 is connected to the shaft hole in a sleeving manner with a clearance fit, thereby implementing idling of the pin rotating shaft in the shaft hole. A pin 471 perpendicular to an exterior cylindrical surface of the pin rotating shaft 47 is disposed at a place, of an extension portion of the pin rotating shaft 47, that corresponds to a step position of the step shaft. The extension portion of the pin rotating shaft 47 is connected to one end of the right handle 45*b*. The right connecting shaft 46*b* connects the other end of the right handle 45*b* to the hinged joint 221 of the right rock arm group 22.

Figure 4:
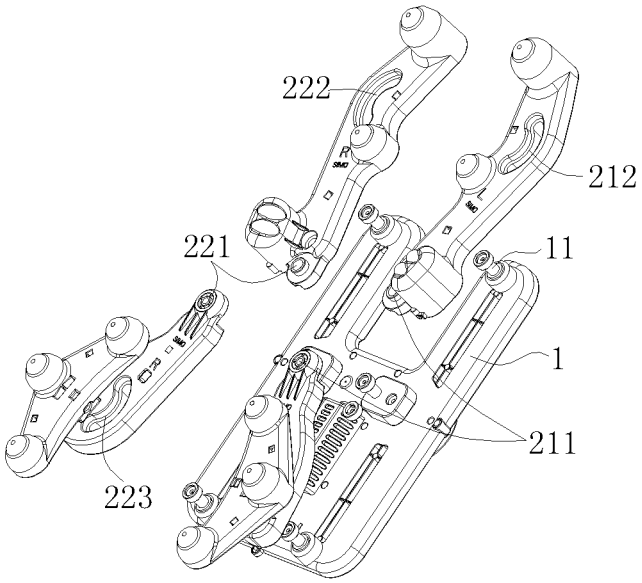
FIG. 4 is a schematic diagram of each rock arm according to the present application.

As shown in FIG. 1 and FIG. 4, an upper spacing groove 212 and an upper spacing groove 222 that are arc-shaped and whose circular centers are toward the housing 1 are respectively provided on the upper rock arms. A lower spacing groove 213 and a lower spacing groove 223 that are arc-shaped and whose circular centers are away from the housing 1 are respectively provided on the lower rock arms. Spacing shafts 11 corresponding to the spacing grooves are disposed on the housing 1. Output motivation of the worm 411 is sequentially transferred through each worm wheel, each small gear, each large gear, and each handle to the hinged joint 211 and the hinged joint 221, thereby respectively driving the left rock arm group 21 and the right rock arm group 22 to move. Under action of the arc-shaped spacing grooves and the spacing shafts 11, the left rock arm group 21 and the right rock arm group 22 implement a rubbing function and a kneading function.

To increase strength of the step shaft on the large right gear, as shown in FIG. 3, the drive apparatus 4 further includes a gear cover 49 on which a shaft hole is formed. A step cover, half of whose end portion is shaved off, extends from an upper surface of the gear cover 49. Several stiffeners extend from an upper surface of the large right gear 44*b*. Slots engaged with the stiffeners are processed and provided on a lower portion of the gear cover 49. When the gear cover 49 is connected to the large right gear 44*b* in a sleeving manner, a step section 491 and a step section 492 on the step cover are respectively aligned, in a same plane, with the step section 441 and the step section 442 of the step shaft on the large right gear 44*b*.

Implementation of the rubbing function and the kneading function: When the motor 41 rotates clockwise, it is assumed that the pin 471 abuts against the step section 491 of the gear cover. In this case, the left rock arm group 21 and the right rock arm group 22 simultaneously knead in a direction that is close to the housing 1. When the motor 41 rotates counterclockwise, the left rock arm group 21 rocks first, and the right rock arm group 22 does not start to act until the pin 471 rotates to the step section 492 of the gear cover (that is, there is an offset of half a rotation period). In this case, the left rock arm group 21 and the right rock arm group 22 simultaneously knead in a direction that is away from the housing 1. When the upper rock arm of the left rock arm group 21 is close to an upper part of the housing 1, the upper rock arm of the right rock arm group 22 is away from the upper part of the housing 1, thereby implementing asynchronous rubbing. When the motor 41 rotates clockwise again, likewise, the right rock arm group 22 does not start to act until the pin 471 rotates back to the step section 491 of the gear cover, and a complete rotation period is formed by adding the half a period that previously lagged behind. In this case, the left rock arm group 21 and the right rock arm group 22 are synchronous again, thereby implementing synchronous kneading.

Figure 5:
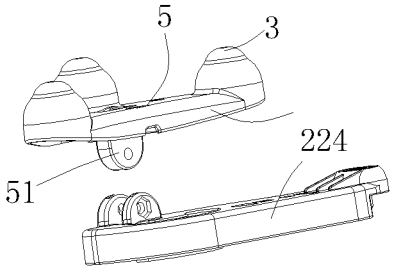
FIG. 5 is a schematic diagram of a connection of a lower rock arm and a swing arm.

To enable the massage heads to automatically fit an S curve of a back of a human body and to be automatically attached to the human body, thereby enriching massage experience, the massage mechanism further includes swing arms 5 that are connected, in a seesaw manner, to the lower rock arms that are respectively on a left side and a right side. Upper portions of the swing arms 5 are also provided with massage heads 3. There are three massage heads 3 in this embodiment, which are disposed in a triangle manner. FIG. 5 is a schematic diagram of a connecting manner of a right lower rock arm 224 and a swing arm 5. A hinged bracket 51 is disposed on a lower portion of the swing arm 5. A bracket with a U-shaped opening corresponding to the hinged bracket 51 extends from an upper surface of the right lower rock arm 224. The hinged bracket 51 is inserted into and hinged with the bracket with a U-shaped opening, so that the swing arm 5 is connected to the lower rock arm 224 in a seesaw manner.

The foregoing descriptions are merely an example of specific implementation manners of the present application, but are not intended to limit the protection scope of the present application. Any variation or replacement readily figured out by a person skilled in the art within the technical scope disclosed in the present application shall fall within the protection scope of the present application. Therefore, the protection scope of the present application shall be subject to the protection scope of the claims.

What is claimed is:

1. A massage mechanism, comprising:

a housing, a massage rock arm group, massage heads, and a drive apparatus;

wherein the massage rock arm group comprises a left rock arm group and a right rock arm group, the left rock arm group and the right rock arm group are respectively mounted on a left side and a right side of the housing in a symmetric manner, and the left rock arm group and the right rock arm group both consist of an upper rock arm and a lower rock arm that are hingedly connected to one another;

the massage heads are disposed on the rock arms;

the drive apparatus is mounted in the housing; an upper spacing groove is disposed on each upper rock arm and a lower spacing groove is disposed on each lower rock arm;

spacing shafts corresponding to the spacing grooves are disposed on the housing; and hinged joints, each between the upper rock arm and the lower rock arm of said left rock arm group and said right rock arm group and driven by the drive apparatus, are provided to drive the left rock arm group and the right rock arm group to perform spacing rocking defined by a path of the spacing grooves;

and wherein the drive apparatus comprises a motor, a left worm wheel, a right worm wheel, a small left gear, a small right gear, a large left gear, a large right gear, a left handle, a right handle, a left connecting shaft, a right connecting shaft, and a pin rotating shaft, wherein an output shaft of the motor forms a worm, and the worm is simultaneously engaged with the left worm wheel and the right worm wheel; the small left gear and the small right gear are respectively mounted on a mounting shaft of the left worm wheel and a mounting shaft of the right worm wheel, and the small left gear and the small right gear are respectively engaged with the large left gear and the large right gear;

a left drive shaft extends from a center of the large left gear, the left drive shaft is connected to one end of the left handle, and the left connecting shaft connects another end of the left handle to the hinged joint of the left rock arm group; a step shaft, half of whose end portion is shaved off, extends from a center of the large right gear;

a shaft hole is processed and formed at a center of the step shaft; the pin rotating shaft is connected to the shaft hole in a sleeving manner with a clearance fit;

a pin perpendicular to an exterior cylindrical surface of the pin rotating shaft is disposed at a place, of an extension portion of the pin rotating shaft, that corresponds to a step position of the step shaft; the extension portion of the pin rotating shaft is connected to one end of the right handle, and the right connecting shaft connects the other end of the right handle to the hinged joint of the right rock arm group.

2. The massage mechanism according to claim 1, wherein the drive apparatus further comprises:

a gear cover on which a shaft hole is formed;

a step cover, half of an is an end portion thereof being shaved off, the step cover extending from an upper surface of the gear cover;

several stiffeners extending from an upper surface of the large right gear;

slots provided on a lower portion of the gear cover, wherein when the gear cover is connected to the large right gear in a sleeving manner, the step cover is aligned with the step shaft on the large right gear.

3. The massage mechanism according to claim 1, further comprising upper spacing grooves and lower spacing grooves, wherein the upper spacing grooves are arc-shaped, and the lower spacing grooves are arc-shaped.

* * * * *